United States Patent [19]

Schneider et al.

[11] Patent Number: 4,981,031

[45] Date of Patent: Jan. 1, 1991

[54] TRANSFER DEVICE IN A TRANSFER PRESS OR SIMILAR METAL-FORMING MACHINE

[75] Inventors: Franz Schneider, Göppingen; Rudi Brandstetter, Adelberg; Wolfgang Michael, Göppingen, all of Fed. Rep. of Germany

[73] Assignee: L. Schuler GmbH, Fed. Rep. of Germany

[21] Appl. No.: 413,607

[22] Filed: Sep. 28, 1989

[30] Foreign Application Priority Data

Feb. 18, 1989 [DE] Fed. Rep. of Germany ..... 3905073

[51] Int. Cl.[5] ..... B21J 13/08

[52] U.S. Cl. ..... 72/405; 198/621

[58] Field of Search ..... 72/405; 198/621; 414/750, 751, 752

[56] References Cited

U.S. PATENT DOCUMENTS

| | | | |
|---|---|---|---|
| 3,760,957 | 9/1973 | Berger | 72/405 |
| 3,875,808 | 4/1975 | Okamoto et al. . | |
| 4,625,540 | 12/1986 | Yamada et al. | 72/405 |
| 4,688,668 | 8/1987 | Ookubo | 414/752 |
| 4,730,825 | 3/1988 | Mikusch et al. . | |
| 4,873,860 | 10/1989 | Werner | 72/405 |

FOREIGN PATENT DOCUMENTS

| | | |
|---|---|---|
| 1271067 | 2/1969 | Fed. Rep. of Germany . |
| 945264 | 12/1963 | United Kingdom . |

*Primary Examiner*—Daniel C. Crane

*Attorney, Agent, or Firm*—Evenson, Wands, Edwards, Lenahan & McKeown

[57] ABSTRACT

A transfer device permits different moving sequences of holding devices for sheet metal parts which are to be moved through a metal-forming machine. The holding devices are fastened to carriages. The carriages are cam-guided, in which case carriage carries out a transfer movement from a working stage to an idle stage while taking along a sheet metal part. The return movement is interrupted in an intermediate position during the deforming operation of the sheet metal parts. The carriage carries out a transfer movement from the idle stage to a working stage and a return movement which is temporarily interrupted in an intermediate stage. As a result of the low-mass construction of carriages, high accelerations are possible in the movements. The transfer movements are shortened significantly by the use of intermediate depositing devices in the idle stages.

8 Claims, 5 Drawing Sheets

42
41
46
22
47
48
4
43
44
45
12
19
20
23
36,37
24
25
26
40
17
27
34
35
28
21
29
30
33
39
1
7
10
31
6
18
14
15
13
9
38
11
3
32
8
2

TRANSFER DEVICE IN A TRANSFER PRESS OR SIMILAR METAL-FORMING MACHINE

BACKGROUND AND SUMMARY OF THE INVENTION

The invention relates to a transfer device in a transfer press or similar metal-forming machine.

Reference is made to the below listed U.S. patent applications:

(i) U.S. Application Ser. No. 380,508, filed July 17, 1989, based on German Application No. P 39 05 068.8 filed in Germany on Feb. 18, 1989!33986!; and (ii) U.S. Application Ser. No. 428,587, filed Oct. 30, 1989, based on German Application No. P 39 05 069.6 filed in Germany on Feb. 18, 1989!33987!.

Transfer presses, bulky-part transfer presses, press installations are metal-forming machines, in which sheet metal parts are deformed by process steps, such as drawing and punching. For this purpose, the presses have at least one slide, at which a tool or a tool set (upper tool) is fastened which cooperates with a tool or tool set (lower tool) in the press bed or on a sliding table. The slides can be moved up and down by driving devices of the press. Intermediate depositing devices are mounted in areas between the frames leading to presses arranged behind them, these areas being known as idle stages. The changing of the tools or tool sets takes place by sliding tables which, for this purpose, can be moved into and out of the press.

In U.S. Pat. No. 4,625,540, a press is disclosed which has a device for the transferring of the sheet metal parts between working stages. This transfer device has two moving rails on both sides of the slides and tools and extending in conveying direction of the sheet metal parts. The moving rails are supported on the press bed by means of supports. In addition, a plate having rollers for placement on the moving rails is provided for each moving rail. Both plates are connected with one another by a strut. Two transfer rods are disposed at the strut which extend in parallel with respect to the moving rails. The transfer rods are connected with a cam follower lever which receives a swing motion from a control cam. On the side of the drive, the control cam is operatively connected with the main drive of the press. The transfer rods are rigidly connected with one another by traverses.

In guides of the transfer rods, cross bars are arranged which by an additional drive can be moved relative to the transfer rods. Vacuum suction devices are mounted at the cross bars which, by the movement of the cross bars, can be adjusted to the length of the sheet-metal parts. For the deforming stage, the cross bars with the vacuum suction devices can be adjusted into areas outside the slides and the tools. The transfer rods can be lifted and lowered by lifting devices which are not shown or explained in detail.

Accordingly, it is an object of the present invention to provide a transfer device which does not hinder the changing operation of the tools by means of supporting and driving devices affecting the transfer device below the level of the sheet metal conveyance.

The moving parts of the transfer device according to preferred embodiments of the present invention are advantageously low in mass and permit high accelerations during a shortened transfer movement and the return of the holding devices gripping the sheet metal parts. For this purpose, the transfer device carries out lifting and lowering movements for removing the sheet metal parts from the tools and for placing them in the tools.

As noted above, the low-mass construction of preferred embodiments of the present invention is advantageous. The driving devices and the devices of the transfer device which transfer and deflect the movements are assigned to the area (head area) of the press or presses, in which the driving devices for the slide or the slides are also housed. The transfer device can be retrofitted in press trains as well as in compact presses. Other advantages of preferred embodiments of the present invention are the short transfer movements of the carriages and their interim waiting position outside the working stages during the deforming phases.

In a particularly advantageous manner, the transfer device according to preferred embodiments of the present invention can be used in a new type of hybrid press installations with intermediate depositing devices set up between two working stages (idle stages) because the carriages, in pairs, can carry out different movements if the drive is designed correspondingly.

Other objects, advantages and novel features of the present invention will become apparent from the following detailed description of the invention when considered in conjunction with the accompanying drawings.

DETAILED DESCRIPTION OF THE DRAWINGS

Figure 1:
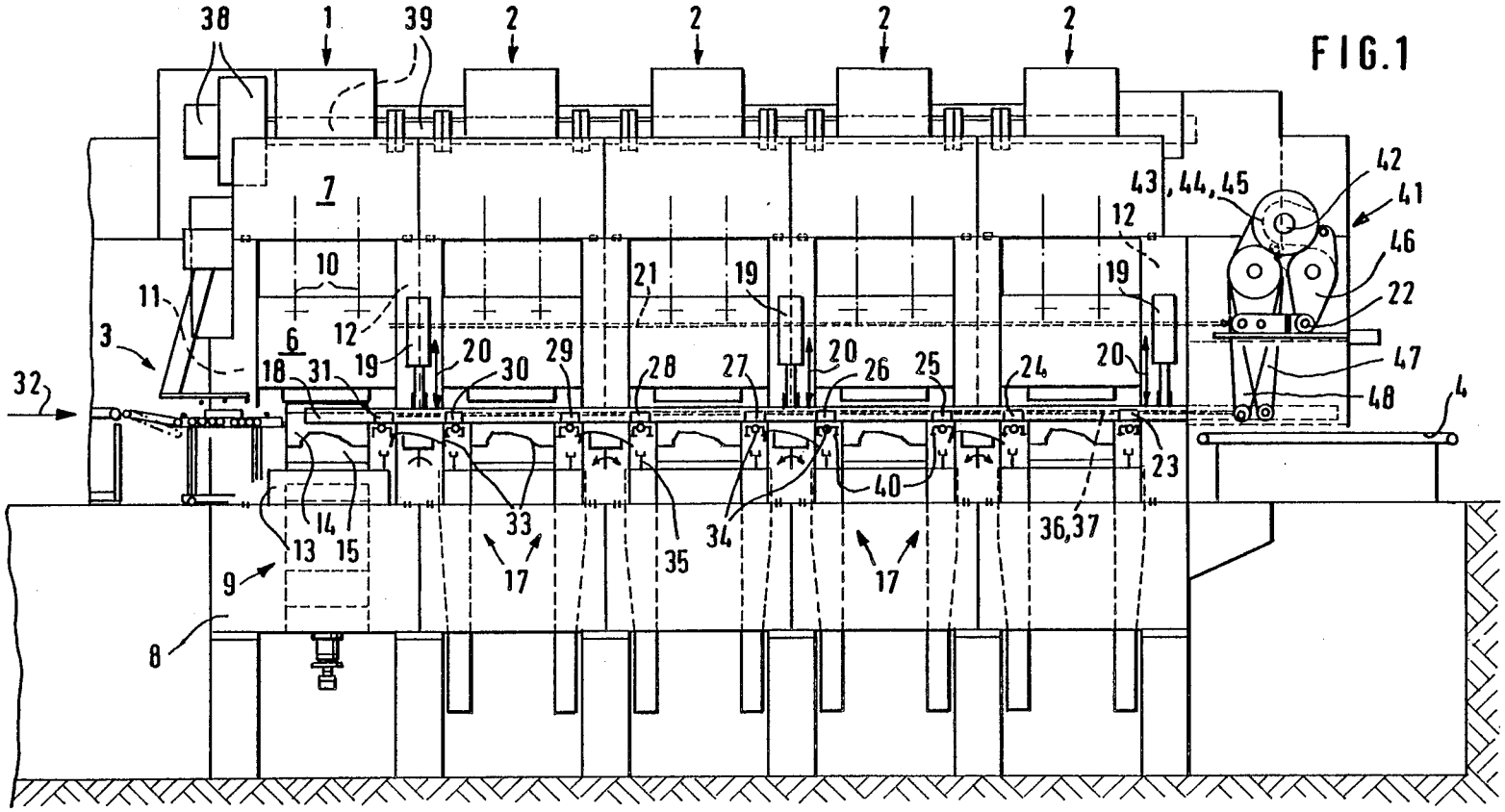
FIG. 1 is a front view of a hybrid press installation, in which support frames located at the front side of press installation are not shown.

In the Figures, a hybrid press installation is shown having a head press 1, which may be a drawing press, and having additional presses 2, of which at least one additional press may contain an additional redrawing stage. The head pieces 7 of the individual presses 1, 2 are supported on press beds 8 by means of frames 11, 12.

The reference number 10 indicates connecting rods which drive the slides 6 of the presses 1, 2 in an upward and downward movement, for example, by means of a crankshaft drive originating from a main shaft 39. The main shaft 39 is rotationally moved by one or several motors via a clutch/brake unit 38. Using sliding table 13, tools or tool sets 14, 15 can be moved into the working stages of the presses 1, 2 and can therefore be exchanged, in which case the tool or the tool set 15 (lower tool part) for the deforming operation of the presses remains on the respective sliding table 13. The tool or the tool set 14 (upper tool part) moves with the movement of the slide 6.

A drawing apparatus 9 is outlined for the head press 1. The metal sheets 33 which are fed, for example, to the head press 1 by a feeding device 3 are moved from one working stage to the next working stage by a transfer device 5 and guided to a removal station 4. Sheet metal parts of different sizes, which are to be conveyed and worked, such as parts 33' shown in FIG. 2 can be accommodated by the transfer device 5. The direction and the level of the sheet metal conveyance has the reference number 32.

Intermediate depositing devices 17 for the depositing of the sheet metal parts 33 are set up in the idle-stage areas between the working stages. Supports 35 are provided at the sliding tables 13 for receiving the traverses 34 of the transfer device 5 which will be described more fulling in the following.

Figure 2:
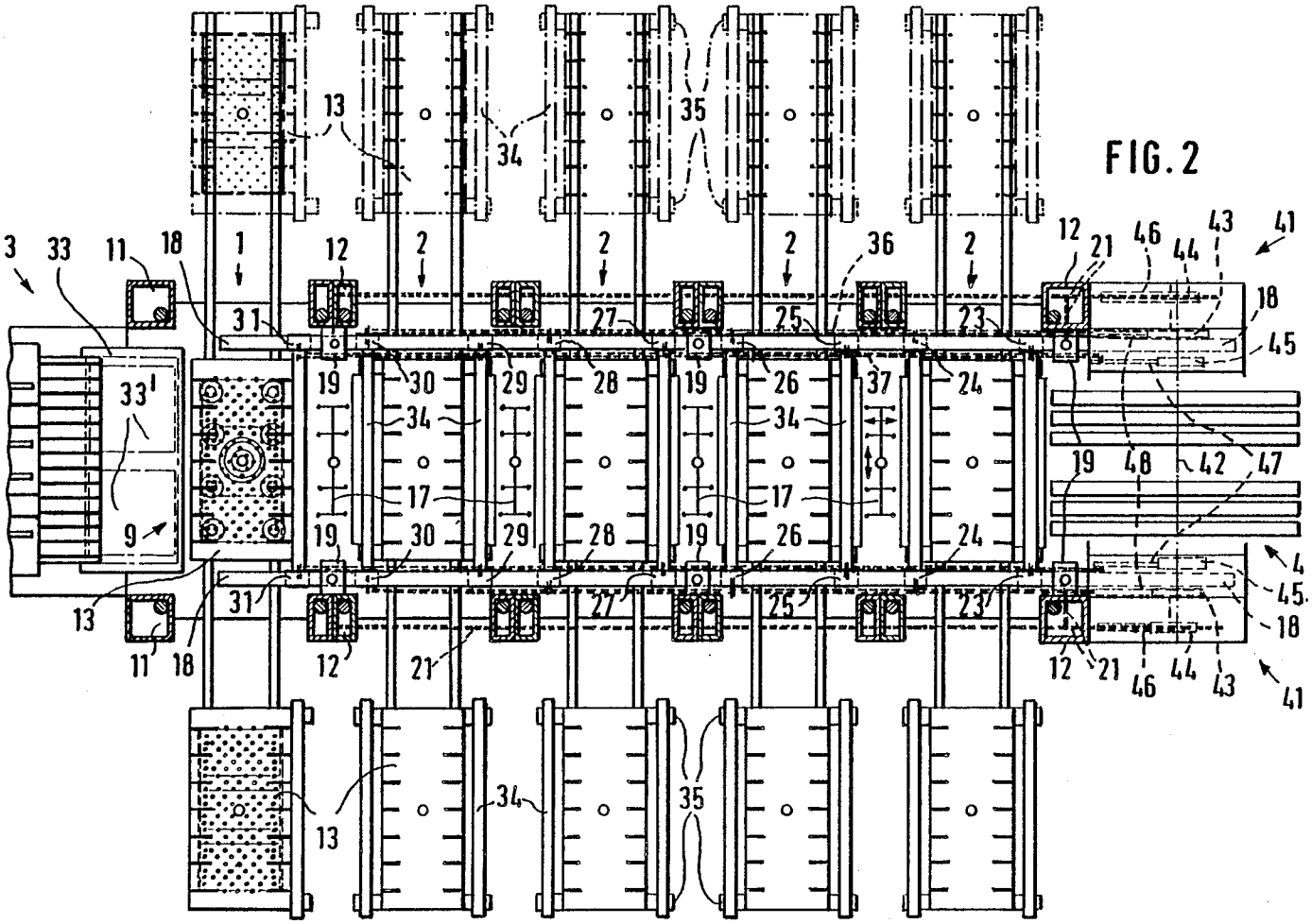
FIG. 2 is a top view of the hybrid press installation according to FIG. 1, in which head pieces are not shown.
Figure 3:
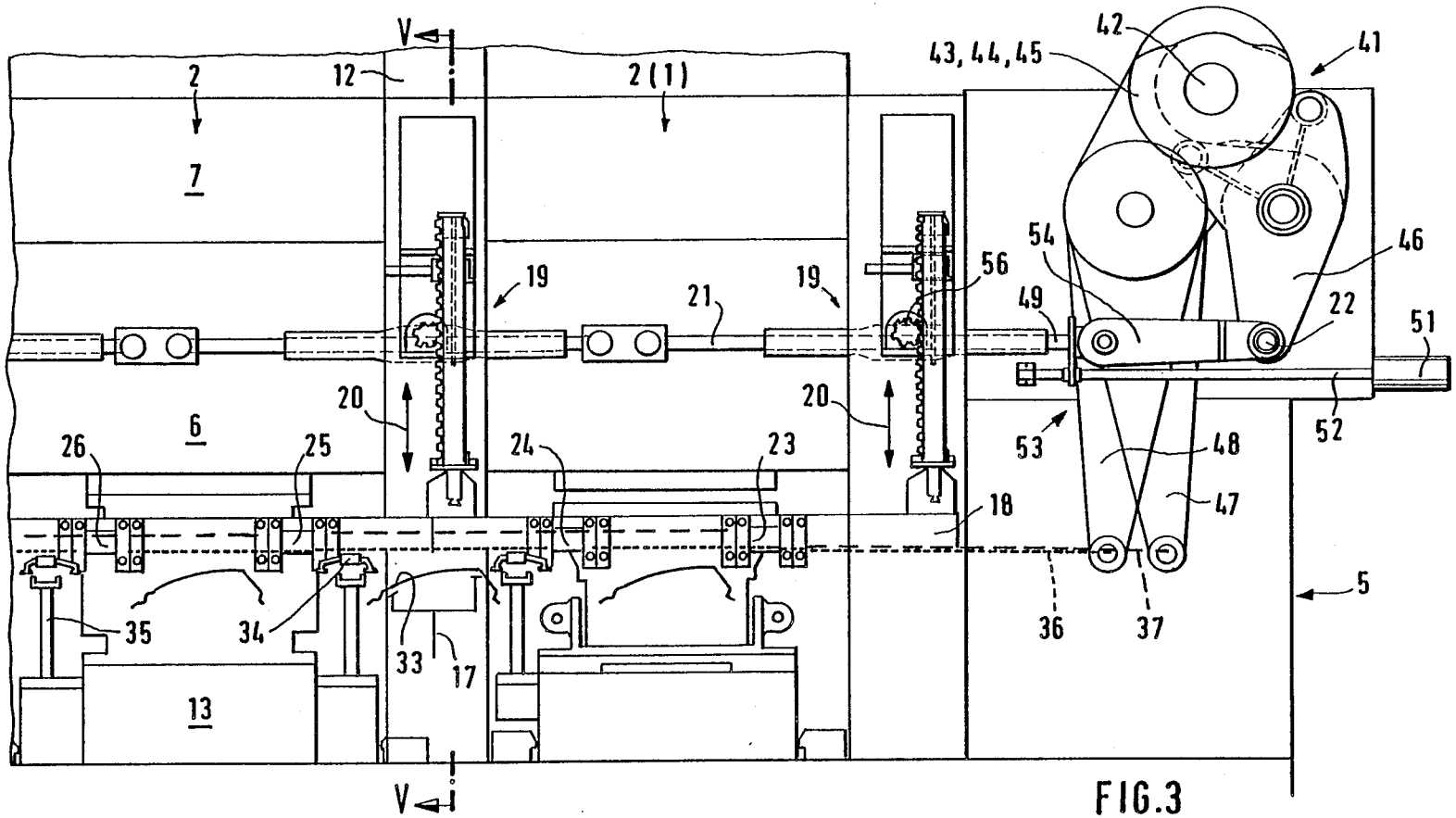
FIG. 3 is an enlarged cutout of FIG. 1 with the driving devices for the transfer device according to one embodiment of the present invention.

The transfer device 5 shown in FIGS. 1, 2 and 3 has two moving rails 18, one of which, in a view of FIG. 1, is arranged behind the slides 6 with the upper tool parts 14, and the second moving rail is arranged in front of the slides 6 with the upper tool parts 14 as viewed in a longitudinal direction of the shown hybrid press installation. The moving rails 18 can be lifted and lowered (double arrow 20) by adjusting devices or the like, such as air cylinders, or, as shown, by deflection gears 19. The deflection gears 19 will be explained in detail with respect to FIGS. 5 and 6 hereinafter.

The deflection gears 19 of the rear frame side and those of the front frame side, by means of one lifting rod linkage 21 respectivelY, in coupling points 22, are connected with one cam follower lever 46 respectively for each frame side of a cam disk arrangement which, as a whole, has the reference number 41. As outlined in FIGS. 1 and 2 and shown in detail in FIGS. 3 and 4, carriages 23 to 31 are disposed at each of the moving rails 18.

Carriages 23, 25, 27, 29 and 31, by means of a conveying rod system 37, are connected with one another and with a cam follower lever 47. Carriages 24, 26, 28 and 30, by means of a conveying rod system 36, are connected with one another and with a cam follower lever 48. The carriages 23 to 31, which are located opposite one another at the spaced moving rails 18, are connected with one another by means of traverses 34. Suction devices 40 or similar holding devices are arranged at the traverses 34 for the gripping of the sheet metal parts 33 and for conveying them through the hybrid press installation. The conveying rod system 36, 37 may be arranged on both sides of the moving rails 18 as seen in FIG. 2 or on one side of the moving rails.

The cam disk arrangement 41, as shown in detail in FIGS. 2 and 3, comprises a cam disk shaft 42. The cam disk shaft 42 is rotated by the main shaft 39 by means of deflecting or transfer gears. These devices, which are known in metal-forming machines, are not shown. For each frame side, one cam disk 44 for the movement of each of the cam follower levers 46, one cam disk 45 for the movement of each of the cam follower levers 47 and one cam disk 43 for the movement of each of the cam follower levers 48 is non-rotatably arranged on the cam disk shaft 42. The cam disks 44, 43, 45 may be double cam disks for generating a controlled motion in the lifting and lowering movements of the moving rails 18 and the transfer movements of the carriages 23 to 31.

Figure 4:
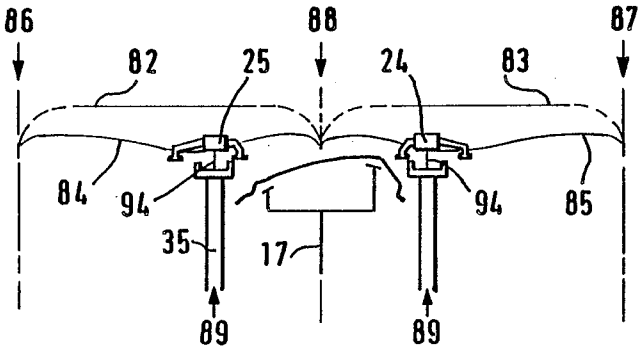
FIG. 4 is a diagram of the movements of the carriages generated by the driving devices shown in FIG. 3.

As shown in FIG. 3, each of the lifting rod linkages 21, at its initial position, can be changed by the lowering movement, as indicated at 94 in FIG. 4, of an adjusting drive in order to achieve an additional lowered position for the moving rails 18 which cannot be provided by the cam disks 44. This lowered position is required for the depositing of the traverses 34 on the supports 35 of the sliding tables 13 during the tool change and the changing of the holding devices 40. For this purpose, each adjusting drive has an adjusting motor 51 which drives a spindle 52. The rotating movement of the spindle 52, by means of a pair of toothed gears 53, is transmitted to a second spindle 49. In the cover plate 54, a moving thread (nut) is inserted which interacts with the spindle 49 and thus, during the rotation of the spindle 49, causes a change of the length of the lifting rod linkage 21.

The cam disks 45, 43 for the movement of the carriages 23 to 31 are designed such in their curved paths tapped by the cam follower levers 47, 48 that the first carriage 23 and each next-plus-one carriage 25, 27, 29, 31, corresponding to FIG. 4, carries out a transfer movement indicated by line 82 in FIG. 4 from a working stage 86 into an idle stage 88 having the intermediate storage device 17 and a return movement 84 into working stage 86 which, in an intermediate position 89 between working stage 86 and idle stage 88, is interrupted during the time of the deformation of the sheet metal parts 33.

The second carriage 24 and each next-plus-one carriage 26, 28, 30 connected with it simultaneously carry out a transfer movement indicated by line 83 in FIG. 4 from an idle stage 88 having the intermediate depositing device 17 into a working stage 87 and a return movement 85 into the idle stage 88 which, in an intermediate position 89 between the idle stage 88 and the working stage 87, is temporarily interrupted for the deforming. The working stages are characterized by the tools 14, 15. The vertically extending motional parts of the curves 82, 83, 84, 85 shown in FIG. 4 are caused by the cam disk 44 which is moved synchronously with the cam disks 43, 45.

Figure 6:
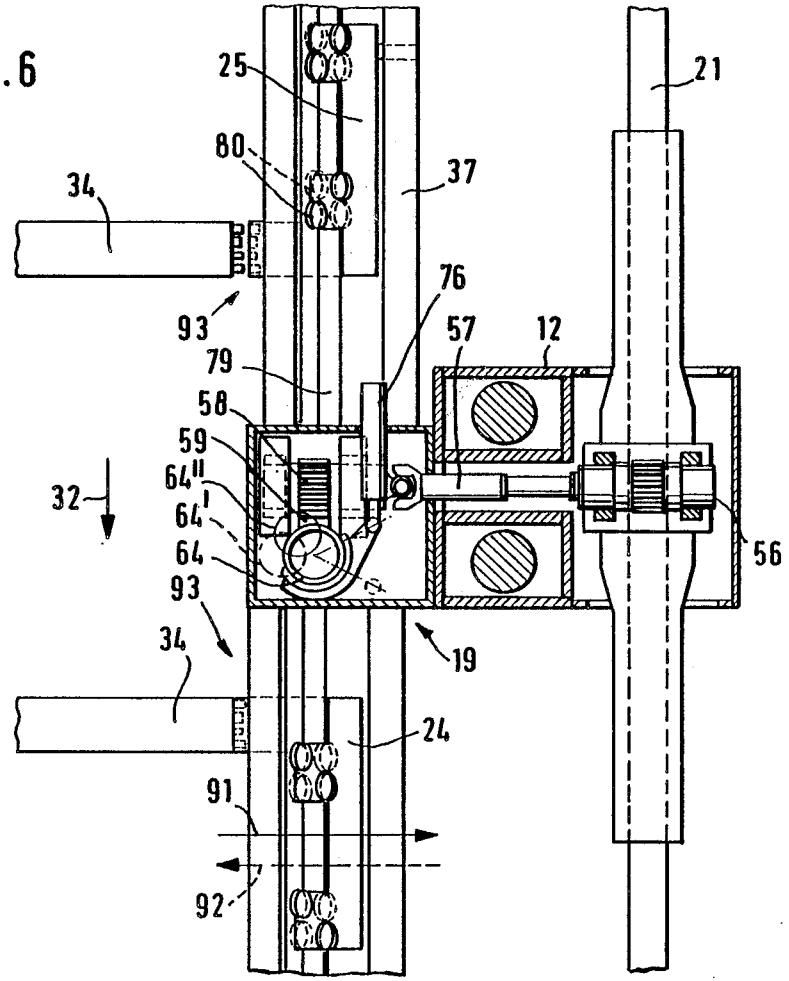
FIG. 6 is a sectional view taken along line VI—VI in FIG. 5.
Figure 5:
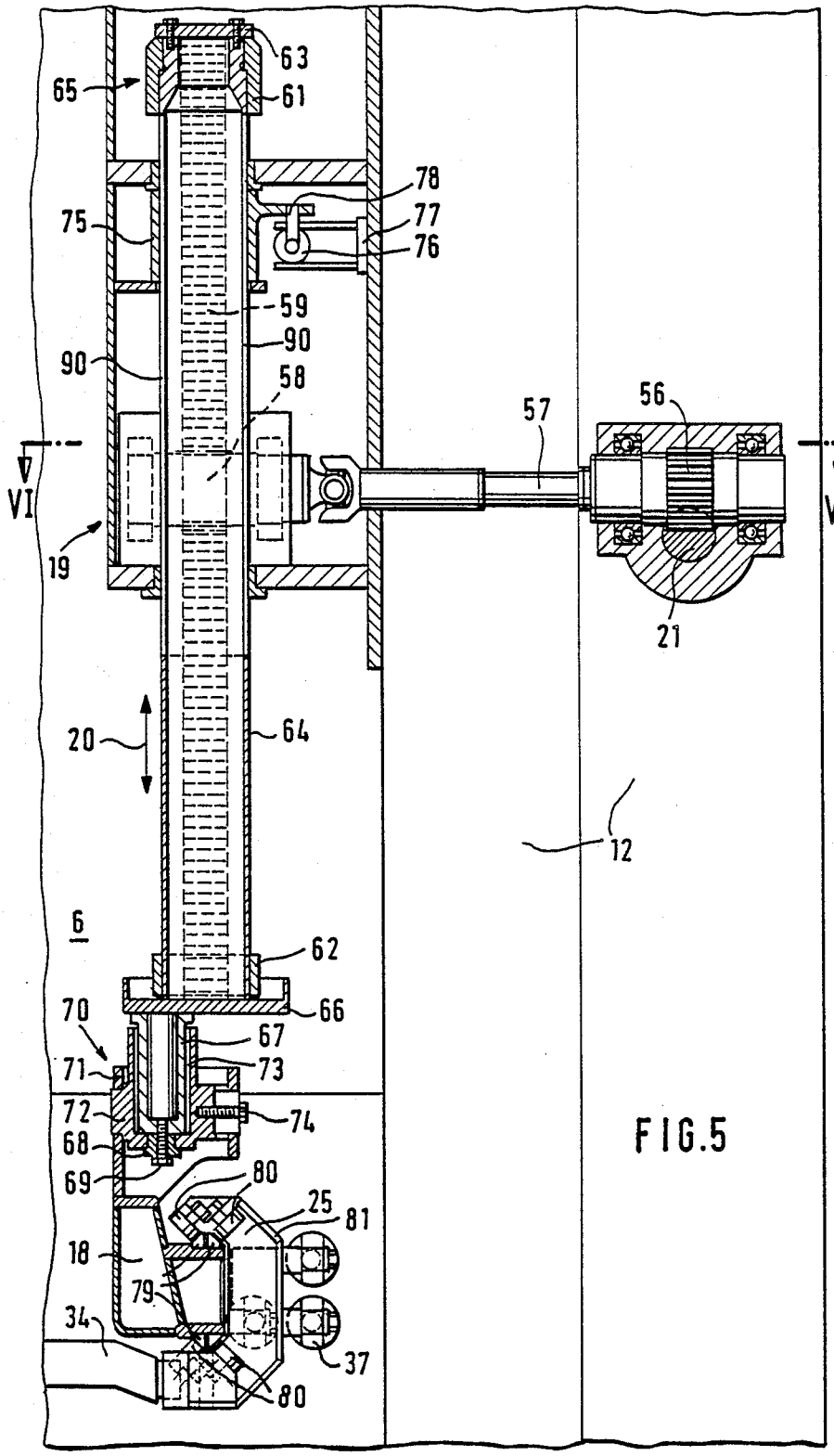
FIG. 5 is an enlarged sectional view taken along line V—V in FIG. 3.

The sectional view of FIG. 5 and partially also the sectional view of FIG. 6 show the area of one of the frames 12 which has a deflecting gear 19. The lifting rod linkage 21, in FIG. 5, extends vertically with respect to the plane of the drawing. The movement of the lifting rod linkage 21, by means of a toothing and engagement with a spur wheel 56 and a rotating shaft 57, is transmitted to a second spur wheel 58. The second spur wheel 58 interacts with a toothed rack 59. The end areas of the toothed rack 59 are firmly connected with an upper flange bushing 61 and a lower flange bushing 62. The upper flange bushing 61 forms a running surface 65 for a lifting pipe 64. The upper flange bushing 61 also interacts with a cover plate 63 which is screwed on an upper collar of the lifting pipe 64. This connection permits a rotation of the lifting pipe 64.

The pivotal movement of the lifting pipe 64 about point A shown in FIG. 6 is caused by means of an adjusting device 76, such as a pressure cylinder which, by means of a bearing block 77, is fixedly mounted at the frame. The bearing block 77 permits a swivelling motion of the adjusting device 76. At reference number 78, the adjusting device 76 is pivotally connected to a ring bush 75. The ring bush 75, for example, by means of guide bolts, engages in longitudinal grooves 90 of the lifting pipe 64 in order to, on the one hand, permit the lifting and lowering movement 20 of the lifting pipe 64 required for the moving rails 18 and, on the other hand, permit the pivotal movement of the lifting pipe 64.

At its lower end part, the lifting pipe 64 carries a flange 66 with a flanged bush 67. The flanged bush 67 is surrounded by a bearing bush 73 and a support bush 72. The support bush 72 is held in a support 71 by means of a screw connection 74. A flange bushing 68 is placed on the lower end of the support bush 72. A screwing device 69 is guided through the flange bushing 68 in order to fasten the support 71 to the lifting pipe 64. The moving rail 18 is rigidly connected with the support 71. The moving rail 18 has two rails or rail pairs 79 on which rollers 80 of carriages 23 to 31 roll, in this case, the rollers 80 of carriage 25. The conveying rod system which is connected to the housing 81 of the carriage 25 has the reference number 37. As a result of the pivotal movement of the lifting pipe 64 by means of adjusting devices 76, an adjustment of the moving rails 18 is possible from the inside to the outside as indicated by arrow 91 in FIG. 6 for example, for the uncoupling of the traverses 34 from the moving carriage 25, or from the outside to the inside as indicated by arrow 92 in FIG. 6 for the corresponding coupling.

FIG. 6 also shows the positions 64' for the operative position and 64'' for the uncoupling and coupling position of the traverses 34 caused by adjusting devices 76.

Reference number 93 indicates coupling areas or couplings for the detaching of the traverses 34 from the carriages, in this case carriages 24, 25, or the coupling to these carriages as a result of a movement of the moving rails 18 in one of the directions of arrows 91, 91. In the operative position, the rails 79 at the moving rails 18 are located in the center with respect to the lifting pipe 64.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A press comprising:

a working stage having at least one slide;

driving means coupled to the slide for moving the slide up and down to deform sheet-metal parts;

sliding tables for facilitating tool change of tools of the slide;

transfer means movable in synchronism with operation of the press, said transfer means having holding means for gripping and conveying sheet-metal parts in a plane of sheet-metal conveyance and shifting means coupled to the holding means for changing a distance of the holding means with respect to one another to thereby position the transfer means outside of the working stage during a deforming of sheet-metal parts, said transfer means also having two moving rails which extend on opposite sides of the slide and in a conveying direction of the sheet-metal parts;

adjusting means coupled to the two moving rails and mounted at frames of the press above the plane of the sheet-metal conveyance for lifting and lowering the two moving rails;

carriages coupled to the moving rails and slidable relative to the moving rails in the conveying direction of the sheet-metal parts, with pairs of carriages being located opposite one another on the moving rails; and traverses coupling the pairs of carriages located opposite one another on the moving rails, said holding means being mounted at the traverses.

2. A press according to claim 1, further comprising adjusting means mounted at the frames for synchronizing the lifting and lowering of the moving rails with the operation of the press.

3. A press according claim 1, wherein the adjusting means includes deflecting gears which are mounted at the frames and which, at an input side, are connected with one cam follower lever respectively, which is moved in synchronism with the operation of the press, and, at an output side, are connected with a moving rail.

4. A press according to claim 1, further comprising one first and one second cam follower lever respectively provided for the carriages of each moving rail, said first and second cam follower lever being moved in synchronism with the operation of the press, and a first linkage that operatively connects each first, third and each next-plus-one carriage at each moving rail with one of the first and second cam follower levers and a second linkage that operatively connects each second, fourth and next-plus-one carriage at each moving rail with another of the first and second cam follower lever.

5. A press according to claim 4, further comprising an intermediate depositing device arranged adjacent the working stage of the press at an idle stage, and cam disks that drive the first and second cam follower levers said cam disks having cam paths such that the first carriage and each next-plus-one carriage, connected with one of the first and second cam follower levers, carries out a transfer movement from a working stage to an idle stage and a return movement into the working stage which, in an intermediate position between the working stage and the idle stage is temporarily interrupted, and wherein the second carriage and each next-plus-one carriages connected with one of the first and second cam follower levers carries out a transfer movement from an idle stage to a working stage and a return movement into the idle stage which is temporarily interrupted in an intermediate position between the idle stage and the working stage.

6. A press according to claim 1, wherein the press is a transfer press.

7. A press according to claim 1, wherein the press is a large part transfer press.

8. A press according to claim 1, wherein the press is a press installation.

* * * * *